United States Patent [19]

Bedell et al.

[11] Patent Number: 4,527,613

[45] Date of Patent: Jul. 9, 1985

[54] METHOD AND APPARATUS FOR SLITTING A CONTINUOUSLY CAST METAL RIBBON

[75] Inventors: John R. Bedell, Madison, N.J.; Eli Rosenthal, Brooklyn, N.Y.

[73] Assignee: Electric Power Research Institute, Palo Alto, Calif.

[21] Appl. No.: 506,399

[22] Filed: Jun. 17, 1983

[51] Int. Cl.[3] ..... B22D 11/06; B22D 11/12

[52] U.S. Cl. ..... 164/463; 164/427; 164/479; 164/263

[58] Field of Search ..... 164/263, 423, 429, 427, 164/463, 479

[56] References Cited

U.S. PATENT DOCUMENTS

| | | | |
|---|---|---|---|
| 3,891,157 | 6/1975 | Justus | 242/56.2 |
| 4,081,892 | 4/1978 | Mercer | 29/421 R |
| 4,155,397 | 5/1979 | Honsinger et al. | 164/263 |
| 4,262,734 | 4/1981 | Liebermann | 164/423 |
| 4,266,112 | 5/1981 | Niedermeyer | 219/121 LN |
| 4,281,822 | 8/1981 | Moller | 266/50 |
| 4,282,921 | 8/1981 | Liebermann | 164/463 |

FOREIGN PATENT DOCUMENTS

| | | | |
|---|---|---|---|
| 11170 | 2/1981 | Japan | 164/263 |
| 158261 | 12/1981 | Japan | 164/263 |

*Primary Examiner*—Nicholas P. Godici
*Assistant Examiner*—Maureen Weikert
*Attorney, Agent, or Firm*—King, Liles & Schickli

[57] ABSTRACT

A method and apparatus for forming a cast metal ribbon with a slit along the ribbon length includes the step of or a means for generating a controlled disturbance of the cast ribbon along a defined and localized width. The disturbance may be generated by a highly defined, needle-sized stream of gaseous media into the ribbon prior to complete solidification, or alternatively, a needle-like ceramic stylus. The dynamic pressure of the gaseous media or depth of stylus may be adjusted to completely penetrate the ribbon, severing the ribbon into multiple ribbons in a single casting; or alternatively, to only partially penetrate the ribbon, forming a score line of weakening and producing multiple ribbons readily detachable from each other along adjoining edges.

17 Claims, 5 Drawing Figures

METHOD AND APPARATUS FOR SLITTING A CONTINUOUSLY CAST METAL RIBBON

TECHNICAL FIELD

The invention relates generally to continuous casting of metal products by controllably depositing molten metal onto a moving chilled substrate. In particular, the invention relates to slitting a cast ribbon along the ribbon length, either to completely sever the ribbon or to form a score line for separation at a later time. The invention will be specifically disclosed in connection with an apparatus for slitting a ribbon of amorphous metal.

BACKGROUND OF THE INVENTION

In a process of continuously casting metal strips such as ribbons, it is common practice to dispense the molten metal through a nozzle onto a moving chilled substrate. The molten metal solidifies soon after contact with the chilled substrate. A cast product having an amorphous molecular structure, in the form of a relatively thin elongated strip or ribbon, has proven to be effective for winding into highly efficient cores of electrical transformers, and other uses. Recent developments in the casting of amorphous metal strips are reviewed in U.S. Pat. No. 4,332,848.

The width of a cast ribbon is generally a function of the longitudinal dimension of a dispensing slot in the nozzle. In the past, ribbons have been cast to a width desired for end use. When a different width is desired, the nozzle is replaced with another nozzle having a dispensing slot of the desired length. Changing nozzles has many disadvantages. Most importantly, the molten metal in the nozzle and the crucible reservoir must be removed and the entire unit cooled causing substantial loss of valuable casting time and several man-hours of labor. Also, a large inventory of nozzles with different slot lengths must be maintained adding to the capital cost of the casting operation. Further, even when nozzles are changed, precision control over ribbon width is difficult to establish and maintain. Although there has been some progress in providing nozzles with movable elements to vary the width of the cast ribbon, such as shown in copending application, Apparatus for Adjustably Controlling the Width of a Cast Metal Ribbon, Ser. No. 482,981, filed Apr. 7, 1983 and assigned to the present assignee, it is still difficult to vary the ribbon width with these devices without stopping the casting assembly.

Relatively narrow ribbons are required for many applications. In the past, these narrow ribbons have generally been formed on the same casting surfaces as wide ribbons. The dispensing nozzle is simply replaced by a nozzle having a shortened discharge orifice corresponding to the width, as noted above. In such circumstances, much of the capacity of the casting assembly goes unused. Further, it has been necessary to individually wind each narrow ribbon with winding equipment.

SUMMARY OF THE INVENTION

Accordingly, it is an object of the invention to provide an apparatus and method of forming different width ribbon without a change in the nozzle.

It is another object of the invention to provide an improved metal casting apparatus and method wherein the cast metal ribbon may be separated into component strips and thus utilize the full capacity of the equipment.

It is a further object of the invention to provide a casting apparatus and method capable of producing a plurality of elongated metal ribbons with a single casting.

It is another object of the invention to provide an arrangement for precisely controlling the width of a cast metal ribbon without terminating the casting operation.

It is yet another object of the invention to provide an apparatus and method of forming an elongated cast metal product of joined multiple ribbons separated by score lines extending along the ribbon length and allowing for detaching the ribbons along their adjoining edges.

Additional objects, advantages, and other novel features of the invention will be set forth in part in the description that follows and in part will become apparent to those skilled in the art upon examination of the following or may be learned with the practice of the invention. The objects and advantages of the invention may be realized and obtained by means of the instrumentalities and combinations particularly pointed out in the appended claims.

To achieve the foregoing and other objects, and in accordance with the purposes of the present invention as described herein, an improved apparatus is provided for casting a continuous metal ribbon having a slit along the ribbon length. The apparatus includes a reservoir for molten metal and a means for dispensing a relatively thin, elongated ribbon from the molten metal in the reservoir. A continuously moving substrate is provided with a casting surface for receiving and quenching the dispensed ribbon. Means are provided adjacent the dispensing means for generating a controlled disturbance of the cast ribbon along a defined and localized width.

In accordance with a further aspect of the invention, the controlled disturbance is generated by directing a pressurized stream of gaseous media against the ribbon as the ribbon is quenched on the moving substrate. The pressurized gaseous stream penetrates the ribbon on the substrate prior to complete ribbon solidification.

According to one aspect of the invention, the pressurized media is ejected under sufficient pressure to completely penetrate the ribbon and sever the ribbon into multiple component ribbon strips.

In accordance to another aspect of the invention, the pressurized media may be reduced in pressure so as not to completely penetrate the ribbon, but produce a score line or weakening along which the ribbon may be separated into component parts at a later time.

According to the method of the invention, a molten metal ribbon is dispensed onto a chilled substrate. A controlled disturbance is generated along a defined and localized width of the cast ribbon for producing a slit line of controlled depth along the ribbon length. In a preferred form of the method, a pressurized stream of fluid, such as a gaseous medium at a selected pressure, is directed into the dispensed metal prior to solidification for producing a slit line of controlled depth along the ribbon length.

Still other objects of the present invention will become readily apparent to those skilled in this art from the foregoing description wherein there is shown and described a preferred embodiment of this invention, simply by way of illustration of one of the best modes contemplated for carrying out the invention. As will be realized, the invention is capable of other different embodiments, and its several details are capable of modifications in various, obvious aspects all without departing from the invention. Accordingly, the drawings and descriptions will be regarded as illustrative in nature and not as restrictive.

BRIEF DESCRIPTION OF THE DRAWINGS

The accompanying drawings incorporated in and forming a part of the specification, illustrate several aspects of the present invention, and together with the description serve to explain the principles of the invention. In the drawings.

Reference will now be made in detail to the present preferred embodiment of the invention, an example of which is illustrated in the accompanying drawings.

BEST MODE OF CARRYING OUT THE INVENTION

Figure 1:
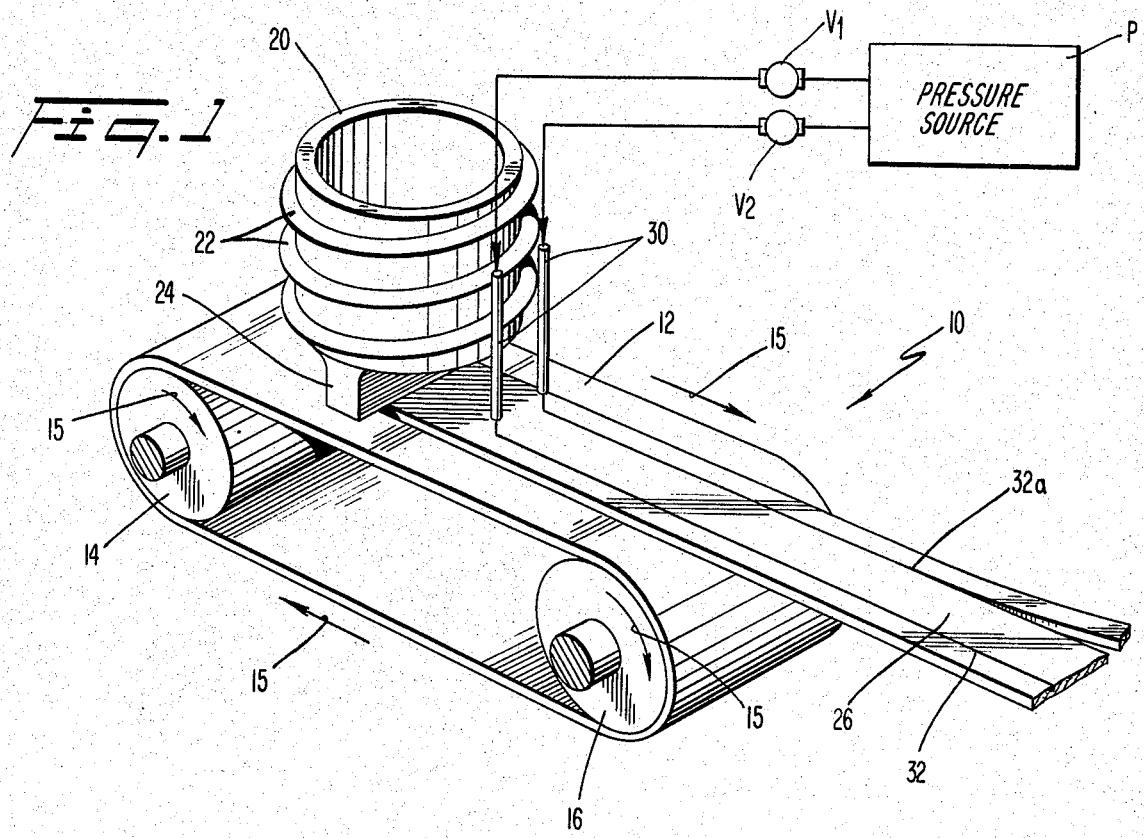
FIG. 1 is a simplified schematic view in perspective showing a casting nozzle dispensing a relatively thin, elongated metal ribbon onto an endless belt with a pair of needle jets producing defined fluid streams to cut slit lines along the ribbon length.

Reference is first made to FIG. 1 schematically depicting a simplified planar casting assembly 10 incorporating the present invention. The assembly 10 includes a moving chilled substrate in the form of an endless belt 12. The endless belt 12 extends between driving means comprising end rollers 14 and 16 for continuous movement. At least one of the rollers 14, 16 is connected to an external power means (not shown) for effecting rotation of the belt 12 in a direction generally indicated by the arrows 15.

A crucible 20 with heater 22 is disposed above the endless belt 12 for providing a molten metal reservoir. A casting or dispensing nozzle 24 is secured to a lower portion of the crucible 20. The nozzle 24 is in open communication with the crucible 20 for receiving molten metal flow from the reservoir. The crucible is pressurized by conventional means (not shown), such as gas overpressure, head pressure of the molten metal or the like for controlling molten metal flow from the casting nozzle 24.

The nozzle 24 is positioned immediately above the belt 12 and is operative to deposit the molten metal received from the crucible 20 onto the upper casting surface. In the preferred embodiment, the molten metal has an amorphous molecular structure.

Figure 2:
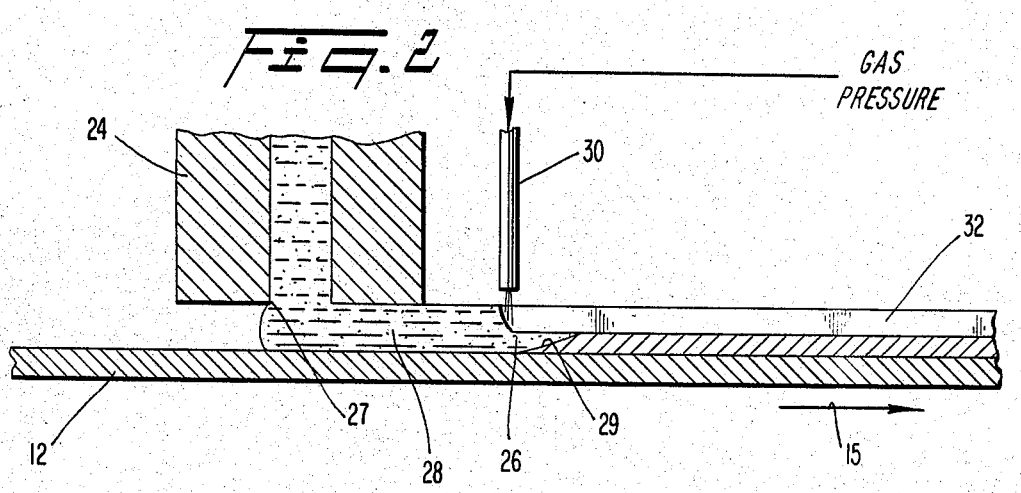
FIG. 2 is a sectional view taken along the casting nozzle and one of the slit lines of FIG. 1 depicting a needle jet issuing a gaseous stream to partially penetrate ribbon producing a score line along the ribbon length.
Figure 3:
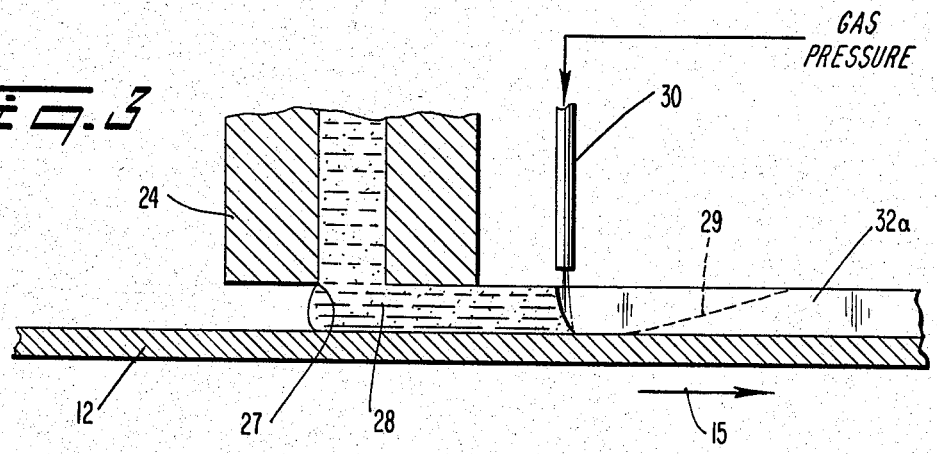
FIG. 3 is a sectional view similar to FIG. 2 but showing complete penetration of the ribbon by the gaseous media producing multiple ribbons in a single casting.

The molten metal is actually discharged onto the moving chilled belt 12 through an elongated discharge orifice 27 in the nozzle 24 as a melt puddle 28 (see FIGS. 2 and 3). The melt puddle 28 quickly solidifies as it is transported away from the nozzle 24 on the chilled belt 12 to form a continuous elongated strip or ribbon 26. Transport of the ribbon 26 continues after solidification as the ribbon 26 is carried to a discharge location beyond end roller 16 for delivery to other processing equipment, such as measuring or winding equipment.

The materials used for the crucible 20 and the nozzle 24 are selected to withstand high temperatures and thermal shock. Further, these metals must not react with the molten metal and must permit fabrication without undue difficulty. Suitable materials for these components include quartz, boron nitride, aluminum oxide, clay-graphite and other refractory materials. The belt 12 is preferably fabricated from flexible metal having a relatively high thermal conductivity, such as copper.

As suggested above, in order to expedite solidification of the ribbon 26, the belt 12 is preferably cooled. Such cooling may be accomplished by a cooling box (not shown) disposed adjacent the belt 12 for spraying the belt with a chilled media, such as chilled water.

FIGS. 2 and 3 show the melt puddle 28 as it is discharged from the nozzle 24 and immediately begins to solidify on the moving chilled substrate belt 12. The solidification is completed at solidification front 29. Defined energy means comprising a pair of jets or nozzles 30 in the embodiment of FIGS. 1–3 are positioned immediately downstream of the dispensing nozzle 24 for generating a controlled disturbance of the melt puddle 28. These nozzles 30 direct a sharply focused, needle-sized pressurized stream of gaseous media to the ribbon 26 as the melt puddle 28 undergoes solidification. The melt puddle 28 is relatively easy to penetrate with the sharply focused, needle-sized gas stream prior to complete solidification. Thus, it is necessary to direct the gas stream into the moving ribbon 26 very shortly after deposit onto the chilled substrate belt 12 upstream of the solidification front 29.

The pressurized stream of gaseous media from the needle jets 30 is provided by a suitable pressure source P (see FIG. 1). The level of pressure is carefully controlled by valves $V_1$, $V_2$ to give the desired slitting action. As will be apparent, the streams penetrate the melt puddle 28 upstream of the solidification front 29 in a focused area of impingement, producing a slit 32 (see FIG. 2) as the ribbon 26 is moved along the belt 12. The degree of penetration is a function of the dynamic pressure of the impinging gaseous media as controlled by the valves $V_1$, $V_2$. It has been found that the gaseous media pressure may be adjusted to either partially or completely penetrate the melt puddle 28.

If a relatively high dynamic pressure is selected, such as through valve $V_2$, to completely penetrate the ribbon 26, the ribbon 26 is severed along slit 32*a* (see FIG. 3) producing multiple ribbons of lesser width than the originally cast ribbon 26. If, on the other hand, a relatively low dynamic pressure is selected, such as at valve $V_1$, to only partially penetrate the ribbon 26, the slit 32 takes the form of a score line. This score line allows for subsequently separating the ribbon 26 along its length into multiple components.

Producing a score line in the ribbon 26 permits multiple ribbons to be wound together as a single large ribbon for easy detachment into component strips of lesser width at a later time.

FIG. 2 depicts the relative penetration of the gaseous stream of the needle jet 30 with the gaseous media of a relatively low pressure to produce the partial slit 32 or score line; whereas, FIG. 3 depicts impingement of greater pressure to completely sever the ribbon 26 and form the slit 32*a*.

It is desirable to direct the impinging stream of gaseous media into the ribbon 26 slightly downstream of the dispensing nozzle 24 but upstream of the solidification front 29. If a partial slit is desired, the gaseous impingement may be located along the solidification front 29 to displace liquid above a solidified zone, preventing further growth of the solid into the liquid above the solidified zone. In this way, finer control over the depth of the partial slit is assured.

The optimum location for impinging the ribbon 26 depends in large part upon the speed of the substrate 12. In the preferred embodiment, an amorphous metal ribbon 26 having a thickness in the order of 0.002 centimeters moves past the dispensing nozzle 24 at a constant velocity between 1000 and 4000 feet per minute. The needle jet 30 is preferably positioned between one half and one and one half inches downstream of the orifice 27 of the nozzle 24. A pressure at valve $V_2$ on the order of three or more pounds per square inch is sufficient in the needle jet 30 to completely sever the ribbon 26 as along slit 32*a*. The pressure is lowered accordingly to provide a sufficient pressure for the desired partial penetration to form the slit 32.

Only two needle jets 30 are depicted in FIG. 1. However, it will be appreciated that the number of jets 30 is a function of the particular application. Some applications may require a single jet 30 while others may require three or more. One jet 30 may form a partial slit 32 and the other a full slit 32*a*, or both the same type slit depending on the adjustment of pressure valves $V_1$, $V_2$. It will also be appreciated that the position of the needle jets 30 may be readily adjusted. Repositioning the jets may be desirable for changing the width of the resulting cast ribbon or for completely changing the slit pattern. Changing the ribbon width may be desirable for making corrective control changes during the casting operation, or for progressively changing the ribbon width according to a predetermined programmed pattern.

Figure 4:
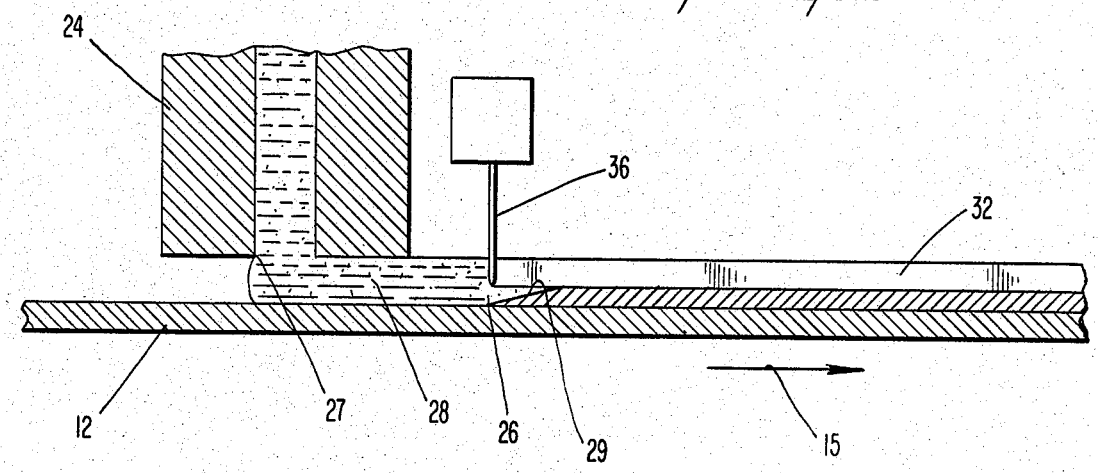
FIG. 4 is a sectional view similar to FIG. 2 but depicting a needle-sized stylus inserted partially through the ribbon to produce a score line along the ribbon length.
Figure 5:
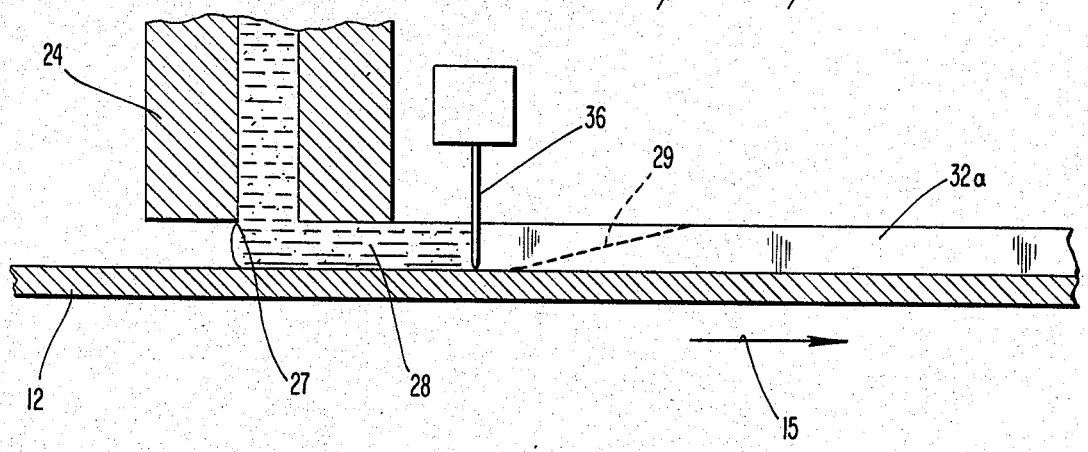
FIG. 5 is a sectional view similar to FIG. 4 but depicting the stylus inserted completely through the ribbon to completely sever the ribbon.

FIGS. 4 and 5 illustrate a further means for generating a controlled localized disturbance of the melt puddle 28. A needle-sized ceramic stylus 36 replaces the nozzles 30 and is inserted into the melt puddle 28. The stylus 36 similarly interferes with the flow of metal along the belt 12 to produce a slit along the ribbon length. FIG. 4 depicts the stylus 36 inserted partially through the melt puddle 28 to produce a score line; whereas, FIG. 5 depicts the stylus 36 inserted completely through the melt puddle 28 to fully sever the ribbon 26. Unlike the pressurized gaseous stream illustrated in FIGS. 1–3, the stylus may be inserted either adjacent the solidification front 29 or further upstream. However, insertion upstream of the solidification front is preferred to reduce resistance from the counterflow of ribbon material and to reduce wear on the stylus 36.

In practicing the method aspects of the present invention, the preferred casting assembly 10 described above, or a similar combination may be used. In the process, a chilled substrate 12 is provided and continuously operated at the required speed. Molten metal is dispensed from the nozzle 24 onto the substrate for solidification into a continuously cast ribbon 26. In accordance with the invention, a localized controlled disturbance is generated in the ribbon 26 to produce a slit along the length of the ribbon. In one preferred procedure, at least one needle-sized pressurized stream of gaseous media is directed against the ribbon prior to complete solidification of the ribbon. The pressure of the gaseous stream is selected so as to be sufficient to provide a partial severing, thus providing a score line 32 or a full severance providing a slit 32*a*. Another preferred procedure includes generating the localized disturbance with a needle-sized stylus.

In accordance with the preferred embodiment, the step of moving the substrate is performed at a rate of between 1000 and 4000 feet per minute and the pressurized stream is impinged against the ribbon between one fourth and one and one half inches downstream of the orifice 27 of the nozzle 24.

Scoring or separating the ribbon 26 with a stream of pressurized gas eliminates the need for contacting the ribbon 26 with a solid severing blade or the like. Problems associated with severing the ribbon 26 with a solid object, such as snagging or uncontrolled ribbon tearing, are thus eliminated. Furthermore, unlike solid severing blades and the like, the needle jets 30 do not directly contact the ribbon 26 and are not subject to the same wearing forces. However in some instances, a solid element is preferred, and for this purpose a ceramic stylus 36 of the embodiment of FIGS. 4 and 5 is preferred.

In summary, numerous benefits have been described which result from employing the concepts of the invention. The needle jets 30 of the invention very precisely form a slit along the length of a continuously cast ribbon 26. The slit 32 may score the ribbon along the ribbon length, producing a series of parallel ribbons attached by a partial thickness of material to each other along their adjoining edges for easy separation at a later time. The slit 32*a*, on the other hand, completely severs the ribbon producing multiple ribbon strips with a simple casting. The slits are generated by needle jets 30 directing a sharply focused, pressurized stream of gaseous media against the cast metal prior to complete solidification. The position of the jets 30 may be readily adjusted to make corrective control adjustments or to change the ribbon width or slit pattern. The adjustments or changes in the ribbon width may be made without interrupting the casting process. Generating a slit 32, 32*a* in the ribbon through the use of a pressurized stream of gaseous media eliminates wear and associated problems attendant to solid severing means. Where solid severing means is required or preferred, a needle-like ceramic stylus 36 is provided (FIGS. 4 and 5) extending into the molten metal puddle, preferably just upstream of the solidification front 29.

The foregoing description of a preferred embodiment and the method of the invention has been presented for purposes of illustration and description. It is not intended to be exhaustive or to limit the invention to the precise form disclosed. Obvious modifications or variations are possible in light of the above teachings. The embodiment was chosen and described in order to best illustrate the principles of the invention and its practical application to thereby enable one of ordinary skill in the art to best utilize the invention in the various embodiments and with various modifications as are best suited to the particular use contemplated. It is intended that the scope of the invention may be defined by the claims appended hereto.

We claim:

1. An apparatus for casting a continuous metal ribbon having a slit along the ribbon length, comprising:

(a) a reservoir for molten metal;

(b) means for dispensing a relatively thin, elongated ribbon from molten metal in the reservoir;

(c) a continuously moving substrate, said substrate including a casting surface for receiving and quenching the dispensed ribbon; and (d) means adjacent to the dispensing means for generating a controlled disturbance of the ribbon while on said substrate along a defined and localized width to produce a continuous slit line along the ribbon length.

2. An apparatus for casting a continuous metal ribbon having a slit along the ribbon length, comrpising:

(a) a reservoir for molten metal;

(b) means for dispensing a relatively thin elongated ribbon from molten metal in the reservoir;

(c) a continuously moving substrate, said substrate including a casting surface for receiving and quenching the dispensed ribbon; and (d) means adjacent to the dispensing means for generating a controlled disturbance of the ribbon while on said substrate along a defined and localized width to produce a slit along the ribbon length, wherein the disturbance generating means includes a stylus inserted into the cast ribbon.

3. An apparatus as recited in claim 2 wherein the stylus is positioned relative to the dispensing means to produce a slit along the ribbon length after the ribbon is deposited on the substrate but prior to complete ribbon solidification.

4. An apparatus as recited in claim 2 wherein said stylus extends only partially through the ribbon to form a line of weakening along which the ribbon may be separated into component parts.

5. An apparatus as recited in claim 2 wherein said stylus extends completely through the ribbon to sever the ribbon into component parts.

6. An apparatus for casting a continuous metal ribbon having a slit along the ribbon length, comprising:

(a) a reservoir for molten metal;

(b) means for dispensing a relatively thin elongated ribbon from molten metal in the reservoir;

(c) a continuously moving substrate, said substrate including a casting surface for receiving and quenching the dispensed ribbon; and (d) means adjacent to the dispensing means for generating a controlled disturbance of the ribbon while on said substrate along a defined and localized width to produce a slit line along the ribbon length, wherein the disturbance generating means includes means for directing a defined pressurized stream of gaseous media against the ribbon as the ribbon is quenched on the moving substrate.

7. An apparatus as recited in claim 6 wherein the stream directing means is positioned relative to the dispensing means to produce a slit along the ribbon length after the ribbon is deposited on the substrate but prior to complete ribbon solidification.

8. An apparatus as recited in claim 7 wherein said stream directing means includes a needle jet.

9. An apparatus as recited in claim 8 wherein said stream directing means includes a gaseous pressure source providing sufficient pressure to form a slit line to completely sever the ribbon.

10. An apparatus as recited in claim 8 wherein said stream directing means includes a gaseous pressure source providing sufficient pressure to only partially penetrate the ribbon forming a line of weakening along which the ribbon may be separated into component parts.

11. An apparatus as recited in claim 2 further including driving means for continuously moving said substrate relative to the dispensing means at a rate between 1000 and 4000 feet per minute, and wherein said stream directing means is located so as to direct the gaseous media at a location between one half and one and one half inches downstream of the dispensing means, whereby the cast metal ribbon being cast may be amorphous.

12. An apparatus as recited in claim 11 wherein said stream directing means includes a gaseous pressure source providing a dynamic pressure on the order of three or more pounds per square inch.

13. A method of forming a slit along the length of a continuously cast ribbon, comprising:

(a) continuously moving a chilled substrate;

(b) dispensing a molten metal ribbon onto the substrate for solidification; and (c) generating a controlled disturbance along a defined and localized width of the ribbon while on the substrate to produce a continuous slit along the length of the ribbon.

14. A method of forming a slit along the length of a continuously cast ribbon, comprising:

(a) continuously moving a chilled substrate;

(b) dispensing a molten metal ribbon onto the substrate for solidification; and (c) generating a controlled disturbance along a defined and localized width of the ribbon while on the substrate to produce a slit along the length of the ribbon, wherein the step of generating a controlled disturbance includes directing a pressurized stream of gaseous media into the disposed metal prior to complete solidification of the ribbon.

15. A method as recited in claim 14 wherein the step of moving the substrate is carried out at a rate between 1000 and 4000 feet per minute.

16. A method as recited in claim 15 including the step of dispensing the metal onto the substrate through a nozzle having a defined orifice and directing the pressurized media stream against the ribbon between one half and one and one half inches downstream of the orifice.

17. A method as recited in claim 16 wherein the metal ribbon being dispensed is in the form of amorphous metal.

* * * * *